US005156714A

United States Patent [19]

Thomas

[11] Patent Number: 5,156,714

[45] Date of Patent: Oct. 20, 1992

[54] HEATER FOR A CORRUGATING MACHINE

[75] Inventor: Charles E. Thomas, Baltimore, Md.

[73] Assignee: United Container Machinery Group, Inc., Glen Arm, Md.

[21] Appl. No.: 528,306

[22] Filed: May 24, 1990

[51] Int. Cl.[5] ..... B31F 1/28; B31F 1/36

[52] U.S. Cl. ..... 156/472; 156/322; 156/459; 156/499

[58] Field of Search ..... 156/459, 470, 471, 472, 156/210, 322, 499, 205; 425/369, 370; 165/168, 170

[56] References Cited

U.S. PATENT DOCUMENTS

| | | | |
|---|---|---|---|
| Re. 30,302 | 6/1980 | Stanislaw | 165/89 |
| 782,558 | 2/1905 | Hahn | 156/470 X |
| 1,035,266 | 8/1912 | Taylor | 156/470 X |
| 2,487,647 | 11/1949 | Goettsch | 156/472 |
| 2,572,972 | 10/1951 | Baldwin | 165/168 |
| 2,674,299 | 4/1954 | Bruker | 154/31 |
| 2,827,873 | 3/1958 | Thorn | 156/470 X |
| 2,932,091 | 4/1960 | Day | 34/124 |
| 2,936.158 | 5/1960 | Ramundo | 257/95 |
| 2,987,105 | 6/1961 | Gebbie | 156/210 |
| 3,120,867 | 2/1964 | Nash | 165/90 |
| 3,228,462 | 1/1966 | Smith, Jr. | 165/89 |
| 3,581,812 | 6/1971 | Fleissner | 165/89 |
| 3,823,047 | 7/1974 | Colombo | 156/322 |
| 3,892,613 | 7/1975 | McDonald | 156/470 X |
| 4,050,510 | 9/1977 | Theysohn | 165/89 |
| 4,453,593 | 6/1984 | Barthel et al. | 165/89 |
| 4,459,726 | 7/1984 | O'Brien et al. | 29/116 |
| 4,683,627 | 8/1987 | Reinhold | 29/110 |
| 4,738,744 | 4/1988 | Saller | 156/472 |

FOREIGN PATENT DOCUMENTS 0092079 10/1983 European Pat. Off. .

OTHER PUBLICATIONS

Simon Container Machinery, "Simon Renge 'R2' Fingerless Single Facer".

Agnati S.p.A., "The most simple high speed single facer: 'The Air Cushion'".

*Primary Examiner*—Michael W. Ball
*Assistant Examiner*—Michele K. Yoder
*Attorney, Agent, or Firm*—Biebel & French

[57] ABSTRACT

A paper corrugating machine is disclosed which includes a heater for preheating the medium prior to the corrugation. The heater includes a curved metal plate where channels are drilled through end faces of the plate. Slots are provided at the end faces of the plate to interconnect pairs of adjacent channels at alternate ends to form a serpentine steam passage through the plate. End caps are welded over the slots to seal the communication between the adjacent interconnected pair of channels. Steam supply ports extend into the serpentine path to steam pressurize the serpentine passage. The heater is placed in a single facer corrugating apparatus above the upper and lower corrugating rolls. A variable wrap mechanism is also disclosed which varies the angle of wrap between the medium paper and the heater.

12 Claims, 3 Drawing Sheets

HEATER FOR A CORRUGATING MACHINE

BACKGROUND OF THE INVENTION

1. Field of the Invention

The subject invention relates to an improved heater for a corrugating machine and, in particular, to a heater for imparting heat to the medium paper.

2. Description of the Prior Art

It is well known in the art to produce corrugated flutes from a flat sheet of paper medium by feeding the flat sheet through two meshing corrugating rolls, where the two rolls have teeth appropriately configured for the requisite flutes on the paper. Prior to feeding the paper into the corrugating rolls, the paper must be conditioned for the reconfiguration, such conditioning typically including both heating and steaming of the paper.

To preheat the paper, a steam pressurized drum heater is typically provided, and operated with steam in the range of 370° F. at 185 psig. The paper is wrapped around the circumference of the drum and the heat from the surface of the drum is transferred to the moving paper. From the drum heater, the paper is fed over a steam chamber, where steam is imparted directly to the paper to loosen the paper fibers, such that the fibers are pliable and more easily formed.

One of the disadvantages to the present heating system is that due to the large internal void created within the drum, and the conditions under which the drum operates, the heating drum must be qualified as a "pressure vessel" under the ASME pressure vessel code. Due to this qualification, the heating drum must include relatively thick walls reducing the maximum possible heat transfer rate from the heating surface to the paper.

Another disadvantage to the drum heater as described above is that due to the thermal inefficiency, the drum must be made relatively large in size, typically in the range of 24 inches in diameter. The drum heater must therefore be placed, exterior to, and typically behind, the corrugating apparatus. Due to this position, there is a considerable distance between the heating drum and the steam chamber, and the paper is cooled during the travel between the heating drum and the steam chamber, thereby further reducing the overall thermal efficiency of this process.

It is an object of the invention then to design a corrugating apparatus and preheater where the thermal efficiency of the overall process is improved.

It is a further object of the invention to design a heater for a corrugating apparatus which allows for an overall compact design of the corrugating apparatus.

It is a further object of the invention to provide for a means to vary the angle of wrap on the preheater to vary the heat transfer for various operating conditions and paper thicknesses, without significantly increasing the tension on the paper due to the frictional force across the heater.

SUMMARY OF THE INVENTION

The objects of the invention were accomplished by providing an apparatus comprising a thermally conductive plate having an upper surface and a lower surface, where a plurality of internal integral channels extend from one end of the plate to the opposite end. Adjacent channels are interconnected at alternate ends to form a continuous serpentine passageway through the plate.

Due to the profile of the steam passageway as a plurality of internal channels, the passageway is located in close proximity to the paper contact surface, significantly increasing the thermal efficiency of the heating apparatus. This allows the profile of the heater to be much smaller, and in fact it is profiled as a curved plate located within the corrugating apparatus directly above the corrugating rolls. This further increases the overall thermal efficiency of the corrugating apparatus since the travel distance of the paper between the heating apparatus and the steam chamber is significantly reduced.

Also due to the increased thermal efficiency, the inventive heating apparatus can be profiled as a curved plate, which assures intimate contact between the paper web and the heated surface. A mechanism to vary the contact surface between the medium and the heater can also be easily provided without greatly increasing the tension on the medium.

DETAILED DESCRIPTION OF THE PREFERRED EMBODIMENT

Figure 1:
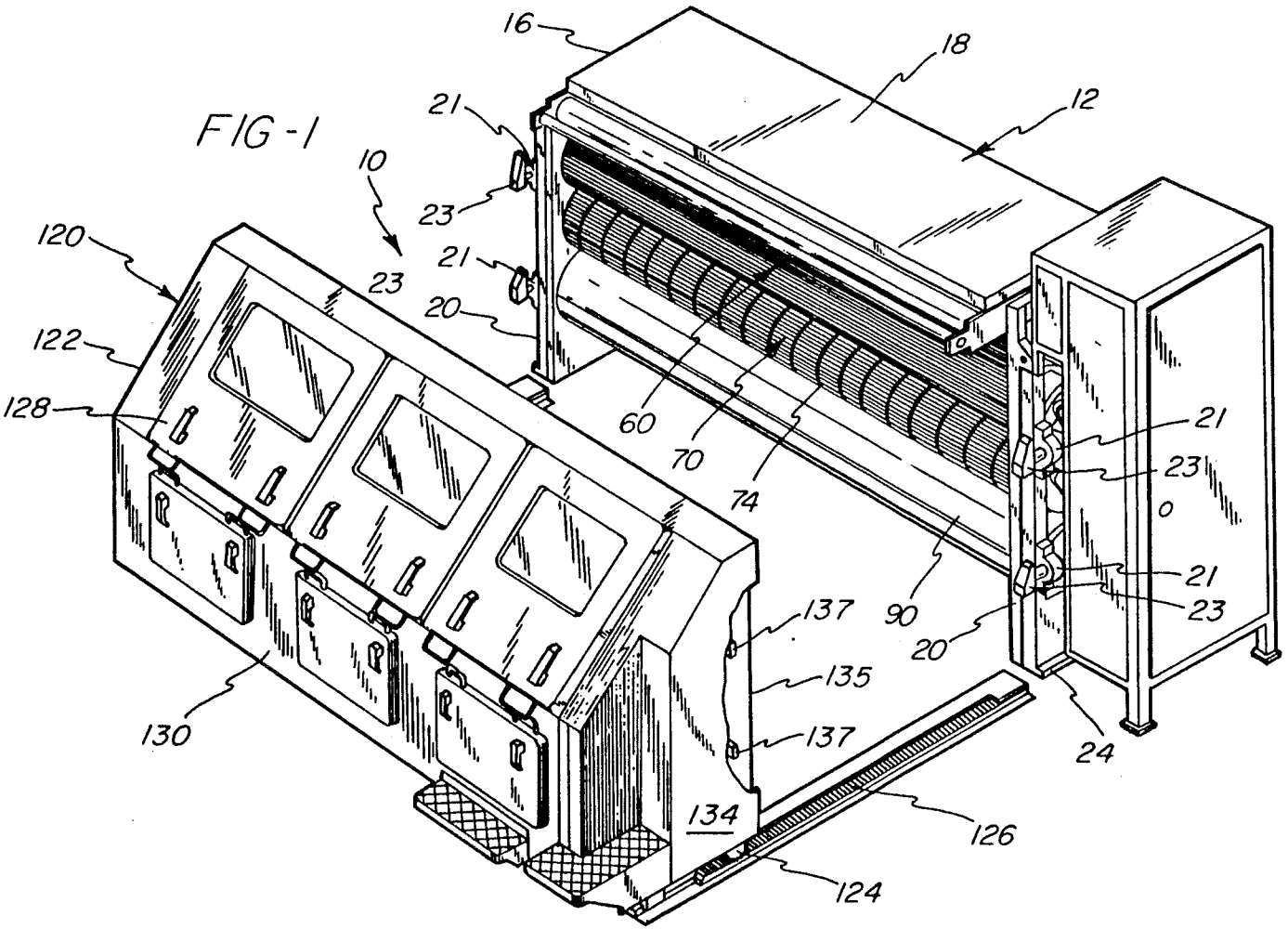
FIG. 1 is a perspective view of the single facer corrugating apparatus of the present invention.

With reference first to FIG. 1, a corrugating apparatus is shown generally at 10, and comprises a corrugating portion 12, and a movable glue unit 120. The corrugating portion 12 generally comprises a structural frame 16, including an upper wall 18, side frames 20, and mounting feet or brackets 24.

Figure 2:
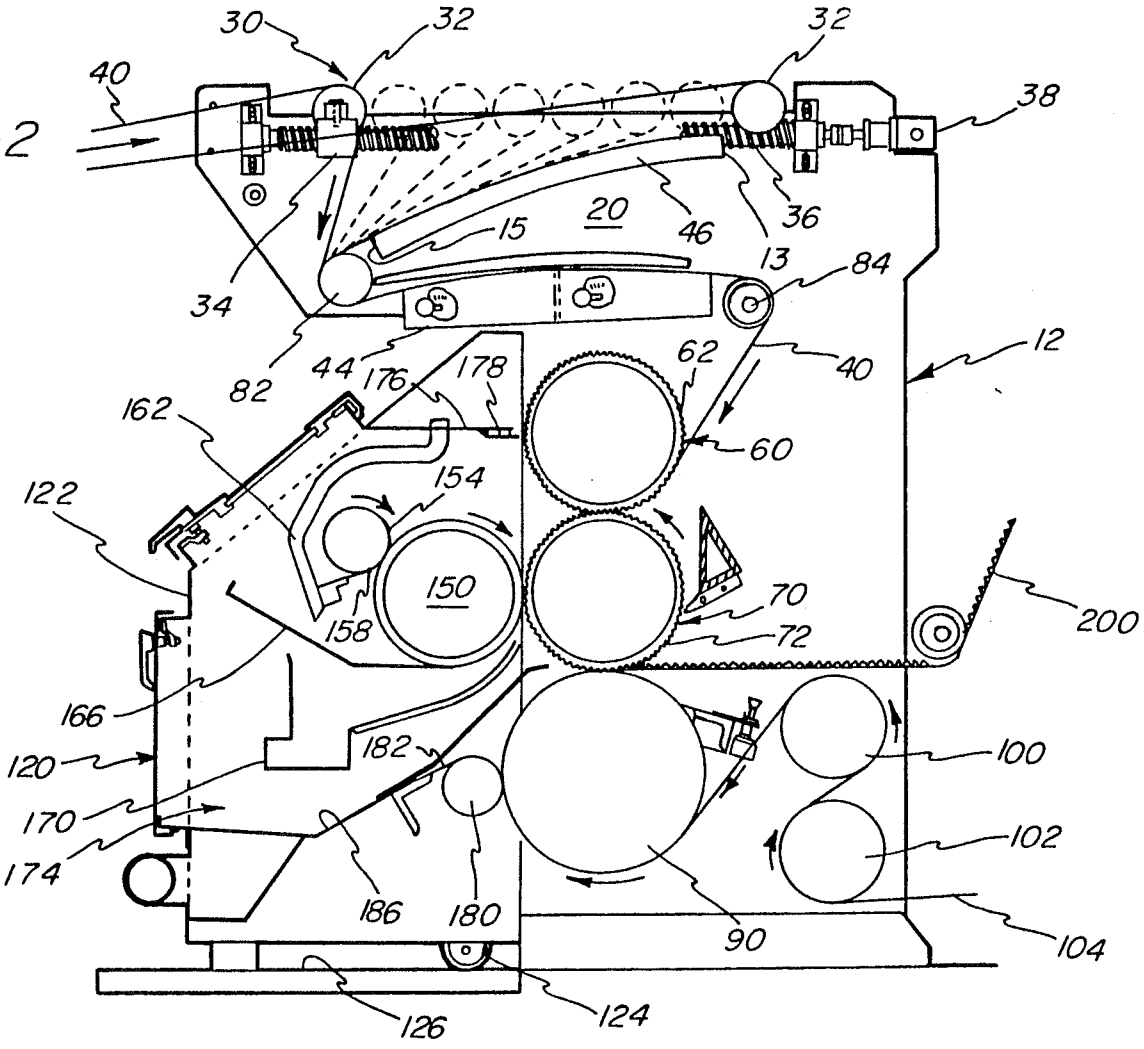
FIG. 2 is a side diagrammatical view of the single facer apparatus of FIG. 1.

With reference now to FIG. 2, the corrugating apparatus includes a variable wrap mechanism 30 including a guide roll 32 for guiding a paper medium 40 into the apparatus, the roll 32 being rotatably attached to a pair of threaded carriers 34 (only one of which is shown). The threaded carriers 34 are driven in a front to rear direction of the apparatus by worm gears 36 which in turn are rotatably driven by a drive unit 38, such as a motor.

As shown in FIG. 2, the threaded carrier 34 and roll 32 are movable to any position between the leftmost position adjacent to the front of the apparatus and the rightmost position adjacent to the rear of the apparatus, to vary the surface area contact between the medium 40 and a heater 46 located directly below the variable wrap mechanism 30. The medium 40 is driven by a driven roll 82 which is powered by a constant torque hydraulic motor (not shown). The driven roll 82 acts to draw the medium 40 around the guide roll 32 and across the heater 46 whereby heat may be transferred from the heater 46 to the medium 40, and the amount of heat transferred may be increased or decreased by increasing or decreasing the surface area contact between the medium 40 and the heater 46.

The medium 40 is further guided from the drive roll 82 in a rearward direction of the apparatus over a steam chamber 44 by an idler roll 84. The steam chamber 44 applies steam against the medium to precondition the medium and is preferably located directly beneath the heater 46 such that a compact preconditioning station is provided within the apparatus.

A pair of conventional corrugating rolls are also provided including an upper corrugating roll 60 and a lower, driven corrugating roll 70, wherein the two rolls 60 and 70 have complementary sinuously shaped meshing teeth 62, 72. The rolls 60 and 70 define a nip area therebetween for receiving and reshaping the medium 40 after it has passed through the preheating section of the apparatus.

The corrugating portion 12 of the apparatus further includes two preheating driven rolls 100 and 102 for heating an incoming length of liner paper 104 which enters the apparatus at a location below the corrugating rolls 60, 70. In addition, a driven pressure roll 90 is located adjacent to a bottom portion of the roll 70 such that a nip area is formed therebetween, and the length of incoming liner paper 104 is conveyed from the preheating rolls 100, 102 to the nip area between the pressure roll 90 and the corrugating roll 70 for combination with the reconfigured medium 40.

With reference still to FIG. 2, the roll away glue unit 120 will be described generally, although the roll away glue unit is described in greater detail in Applicants' patent application Ser. No. 07/528,298 filed concurrently herewith, and is incorporated herein by reference. The roll away glue unit comprises a structural housing 122 including upper and lower front housing portions 128, 130 and side housing portions 134. Rollers 124 and a complementary linear track 126 are provided for allowing the glue unit 120 to be driven towards and away from the corrugating unit 12.

The roll away glue unit 120 also includes a glue supply system, including a glue roll 150 in engagement with the lower corrugating roll 70, a metering roll 154, a glue supply manifold 162, a glue pan 166, a scraper blade 158 and a glue return manifold 170, which elements operate to supply glue to the medium as it passes around corrugating rolls 70 in a conventional manner known in the art. Finally, the roll away glue unit 120 includes an upper plate 176 extending from the upper housing wall 128 and having a sealing tip 178 extending therefrom, and projecting towards the upper corrugating roll 60 to form an upper seal between the glue unit 120 and the corrugating unit 12.

A lower sealing structure is provided and includes a sealing roll 180 in engagement with the pressure roll 90, and a lower plate 186 extending from the lower front wall 130 and having a sealing tip 182 riding on the surface of the sealing roll 180 whereby a lower seal is formed between the glue unit 120 and the corrugating unit 12 with the lower plate 186 having at its end a sealing tip 182 which rides on the surface of the sealing roll 180. Thus, a sealed chamber area 174 is formed by the front walls 128, 130 and sidewalls 134, (FIG. 1), in combination with the plates 176, 186, and the sealing roll 180 such that the chamber 174 within the glue unit 120 may be pressurized.

Figure 3:
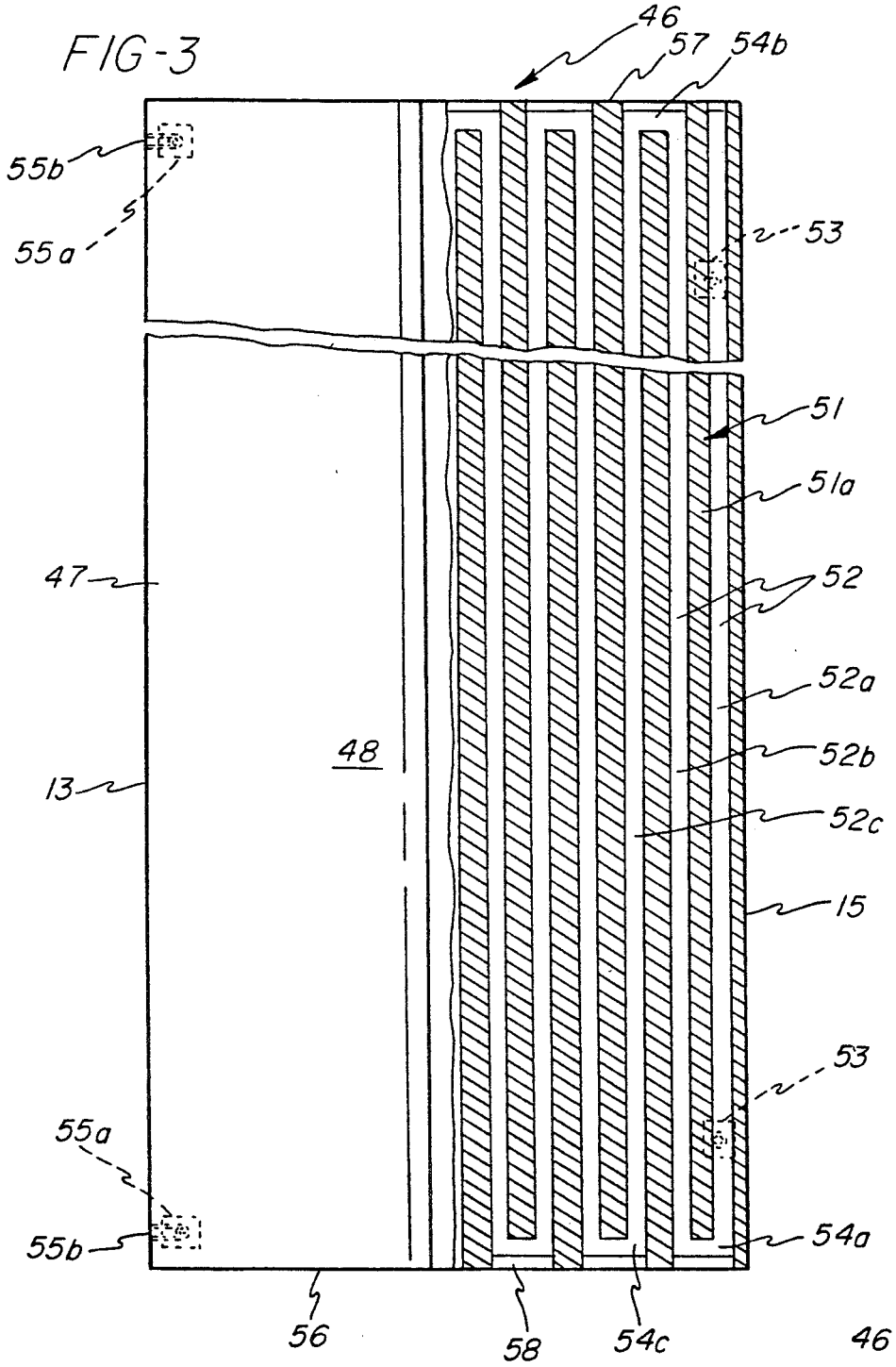
FIG. 3 is a partially cut away plan view of the preheater plate of the present invention.
Figure 4:
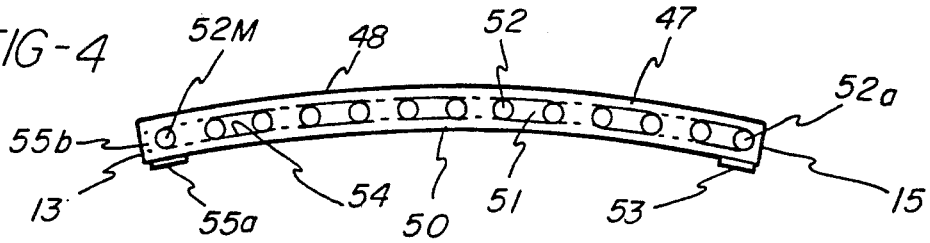
FIG. 4 is an end view of the preheater plate of the present invention with the end caps removed.

With reference now to FIGS. 3 and 4, the heater 46 will be described in greater detail. The heater 46 is defined by a steel plate 47 having opposing end faces 56, 57 extending transversely to and connecting first and second edges 13, 15, and further including a plurality of channels 52 extending along a longitudinal length of the plate between the end faces 56, 57 of the steel plate 47 in a manner similar to that disclosed for the heaters in U.S. patent application Ser. No. 07/528,294, filed on even date.

In the preferred embodiment of the invention, the steel plate 47 is comprised of a carbon steel, although other known materials having suitable heat transfer qualities are also possible. It should be noted that the heater 46 is arcuately formed, as shown in FIG. 4, and in the preferred embodiment, the arcuate shape is formed by rolling the plate 47 into the requisite curvature. Also, in the preferred embodiment of the invention, the channels 52 are cylindrical and are formed by drilling through the plate from end to end, preferably after arcuately forming the plate 47, thereby defining walls 51 between the channels. The walls and channels are referred to generally as 51 and 52, respectively, although specific walls and channels will be referred to with a letter identifier added to the reference numeral 51 or 52.

A continuous passageway through the heater 46 is formed by interconnecting adjacent channels 52 at an end face 56, 57. In the preferred embodiment, adjacent channels 52 are interconnected at alternating end faces 56, 57 to form a serpentine path through the heater 46. To interconnect adjacent channels, slots shown generally at 54, are provided in the end faces 56, 57. For example, and as shown in FIG. 3, slot **54*a* is included at the end face 56 to interconnect the first two channels 52*a* and 52*b*, whereas the second and third channels 52*b* and 52*c* are interconnected by slot 54*b* at the opposite alternate end 57. In the preferred embodiment of the invention, the slots 54 are formed by milling a portion of the wall 51 between two channels 52 at the appropriate end face 56, 57**.

The continued provision of slots 54 between adjacent channels 52 at alternating ends 56, 57 defines a serpentine path through the heater 46. To seal the interconnections between the alternate channels 52, end caps or plates 58 are placed within the slots 54, only partially filling the void created by the slots 54, and are preferably welded to the end faces 56, 57 of the heater 46.

The serpentine path formed by the channels 52 is provided with alternate inlet ports **55*a* and 55*b* at each end of the heater 46, and alternate outlet ports 53 at each end of the heater 46. The inlet ports 55*a*, 55*b* intersect with the channel 52*m*, (FIG. 4) whereas the outlet ports 53 intersect with channel 52*a*, whereby steam may be provided to and removed from the interior of the plate 47, within the serpentine path, to maintain the heater 46 at a desired temperature. The inlet 55*a*, 55*b* and outlet 53 ports are provided at alternative locations in the plate, to provide for flexibility in interconnecting the steam piping. As seen in FIG. 3, the inlet port 55*a* or 55*b* may be located adjacent to the second edge 15 such that the steam will travel back and forth between the end faces 56, 57 of the plate 47, transverse to the direction of travel of the medium 40, until it reaches the outlet port 53 at the first edge 13**.

As may be seen in FIG. 4 the channels 52 may be substantially equally spaced between an upper surface 48 and lower surface 50 of the plate 47 whereby efficient heat transfer by conduction from the steam within the plate 47 to the exterior surfaces thereof is effected. Alternatively, the channels 52 may be located closer to the upper surface 48 than to the lower surface 50 such that a greater amount of heat transfer will occur through the upper surface 48 of the plate 47 than through the lower surface 50.

In either event, the thickness between the channels 52 and the upper surface is less than the thickness of the previous heating drums. In the preferred embodiment of the invention, the channels are equally spaced between the upper and lower surface 48, 50, with a thickness between the channel and upper surface of approximately one-half inch. In previous drum heaters, the thickness between an inside cavity and an outer heating surface was approximately ¾ inches, providing a lower heat transfer rate.

The apparatus shown in FIGS. 1 and 2 and described above is used for making single faced corrugated board, that is, a corrugated sheet which is adhesively fixed to a flat liner paper on one side only, leaving the corrugated flutes exposed on the opposite side. With reference to FIG. 2, the paper 40 to be corrugated, typically referred to as the medium, is fed over the roll 32, and over the rolls 82 and 84. With the threaded carrier 34 properly adjusted along the worm gear track 36 to provide for the appropriate surface area contact or angle of wrap of the medium 40 with the heater 46, the paper medium 40 is first heated by the heater 46 and is immediately thereafter conditioned by the steam chamber 44.

It should be noted that the heater 46 is formed with a convexly or arcuately curved upper plate surface 48 extending between the first edge 13 and the second edge 15. The second edge 15 is located adjacent to the drive roll 82 such that, as the guide roll 32 is moved from its leftmost position to its rightmost position to move the point of initial contact between the medium 40 and the heater 46 toward the first edge 13, the medium 40 will engage a greater surface area of the heater 46. Thus, for a given temperature of the heater 46 and transfer speed of the medium 40, a greater amount of heat will be transferred to the medium 40, as the roller is moved to the right (as viewed in FIG. 2).

With the medium 40 heated and conditioned by the heater 46 and steam chamber 44, the fibers of the medium are somewhat loosened and softened and are fed into the nip point between the upper and lower corrugated rolls 60 and 70, reshaping the medium 40 into flutes having the same configuration as the teeth 62, 72 of the corrugating rolls 60, 70. The corrugated medium then continues around the lower corrugating roll 70 where adhesive is applied to the tips of the flutes by the rotating glue roll 150.

The paper 104, typically referred to as the liner, is preheated by the heated rolls 100 and 102 and is fed around the pressure roll 90 and into the nip point between the lower corrugating roll 70 and the pressure roll 90. The corrugated medium 40 and the liner paper 104 are merged at this nip point and, due to the heated pressure roll 90, the medium 40 is cured and the adhesive gelatinized to form the single faced corrugated board 200.

The above-mentioned apparatus has proven to be quite advantageous. With the configuration of the heater 46 in the serpentine path, as opposed to an open heating vessel, the heater 46 does not have to conform to the ASME pressure vessel code. This allows the channels 52 to be spaced relatively close to the upper surface 48 of the heater 46 providing a higher heat transfer rate than previous drum heaters, given the same operating conditions of the internal steam. This higher heat transfer rate allows the upper heating surface 48 to retain a higher temperature when the single facer apparatus is operating. When the heater 46 is supplied with steam at 370° F. at 185 psig, and when the single facer apparatus is operating, it has been found that the upper surface temperature can be retained between 330° and 340° F., as opposed to previous drum heaters which could only maintain a surface temperature of approximately 300° F. The higher operating surface temperature provides for a more thermally efficient heater allowing the heater 46 to be smaller in configuration than previous drum heaters.

With the increased thermal efficiency of the heater 46, the heater 46 can be configured as a shallow curved plate which is profiled to fit within the periphery of the single facer apparatus 10. This prevents a large length of heated paper between the heater 46 and the steam chamber 44 which typically results in cooling of the medium 40 in transit to the steam chamber 44.

Due to the location of the heater 46 above the corrugating rolls, a variable wrap mechanism 30 can be positioned above the heater 46 providing for easier feeding of the paper medium into the corrugating apparatus. With the roll 32 positioned in the forwardmost position (to the left in FIG. 2), the operator can stand adjacent to the front of the machine and feed the medium 40 over the roll 32, such that the paper drapes over the driven roll 82. The paper can then be fed by the operator beneath the driven roll 82 and over the steam chamber 44 towards the rear of the apparatus. The operator can then move to the rear of the machine and feed the paper over the idler roll 84 and towards the corrugating rolls 60 and 70.

By providing a heater configured as a curved plate, the curved plate in combination with the variable wrap mechanism can be used to vary the surface contact between the medium 40 and the heater 46 to thereby control the heat transfer to the medium 40 independently of the paper feed speed and the temperature of the heater 46. It is desirable to have a variety of preheat settings, due to the variety of both the speeds at which the paper is fed, and the paper thicknesses which are used.

While the form of apparatus herein described, and the method of making the apparatus, constitute preferred embodiments of the invention, it is to be understood that the invention is not limited to this precise form of apparatus and method, and that changes may be made in either without departing from the scope of the invention, which is defined in the appended claims.

What is claimed is:

1. An apparatus for the manufacture of single face corrugated board, the apparatus comprising:

heating means comprising at least one plate having an upper and lower surface extending between end faces of the plate, a plurality of channels integrally formed in said at least one plate and extending through the plate between the end faces, the channels being parallel to the upper surface and interconnected to form a serpentine path circulating through the plate proximate to the upper surface of the plate;

means to supply pressurized steam to the serpentine path of the plate to conductively heat the surfaces of the plate;

a first feed mechanism for continuously feeding a medium over the plate, the feed mechanism delivering the medium across the upper surface of the plate to preheat the medium;

means to apply steam against the medium to precondition the medium for forming;

first and second meshing fluted rolls for accepting therebetween, the medium, to form sinuous flutes on the medium perpendicular to a travel direction of the medium;

heating driven roll means in pinched relation with the second fluted roll;

means to apply adhesive to the medium; and a second feed means for delivering a liner paper between the second fluted roll and the heated driven roll means where the liner paper and medium are pinched together to form a bonded single faced corrugated sheet.

2. The apparatus of claim 1 wherein the channels in the plate extend in the longitudinal length of the plate, perpendicular to the medium travel direction, where adjacent pairs of channels are interconnected at alternate ends of the channels.

3. The apparatus of claim 2 wherein the end faces of the plate include slots to interconnect alternating pairs of adjacent channels.

4. The apparatus of claim 3 wherein the slots are covered by end plates to seal the communication between the adjacent channels.

5. The apparatus of claim 1, wherein the upper and lower surfaces of the plates are arcuately curved in the direction of the medium travel.

6. The apparatus of claim 1, wherein the channels are centered relative to the upper and lower surface.

7. The apparatus of claim 1, further comprising means for adjusting the angle of wrap of the medium on said upper surface of said at least one plate.

8. The apparatus of claim 7, wherein the angle wrap adjusting means comprises at least one idler roll fixed to a threaded carrier, the threaded carrier being driven by a worm gear to move the idler roll from a position adjacent to a front of the curved heating plate, where the medium is not in contact with the curved heating plate, to a position beyond a rear of the curved heating plate to allow a maximum angle of wrap over the heating plate.

9. An apparatus for the manufacture of corrugated board, the apparatus comprising:

a curved heating plate mounted within the apparatus, the heating plate having an inner steam passageway integrally formed in said curved heating plate by interconnected channels, and an upper heated surface, said passageway being a serpentine shape;

means to supply pressurized steam to the inner steam passageway of the heating plate to conductively heat the surface of the plate;

steam supply means to apply steam against the medium to precondition the medium for forming, the steam supply means being mounted beneath the curved heating plate;

medium supply means for continuously feeding a medium to be corrugated over both the curved heating plate and steam supply means, the medium supply means delivering the medium across the upper surface of the heating plate to preheat the medium, and across the steam supply means to precondition the medium;

first and second meshing fluted rolls for accepting therebetween, the medium from the steam supply means, to form sinuous flutes on the medium perpendicular to the length of the medium;

heated driven roll means in pinched related with the second fluted roll;

means to apply adhesive to the medium; and a second feed means for delivering a liner paper between the second fluted roll and the heated driven roll means where the liner paper and medium are pinched together to adhesively fix the sinuous flutes to the liner paper.

10. The apparatus of claim 9, wherein the medium supply means includes a driven roll positioned between the curved heating plate and the steam supply means.

11. The apparatus of claim 9, further comprising means for adjusting the angle of wrap of the medium on the curved heating plate.

12. The apparatus of claim 11, wherein the angle wrap adjusting means comprises at least one idler roll fixed to a threaded carrier, the threaded carrier being driven by a worm gear to move the idler roll from a position adjacent to a front of the curved heating plate, where the medium is not in contact with the curved heating plate, to a position beyond a ear of the curved heating plate to allow a maximum angle of wrap over the heating plate.

* * * * *

UNITED STATES PATENT AND TRADEMARK OFFICE

CERTIFICATE OF CORRECTION

PATENT NO. : 5,156,714

DATED : October 20, 1992

INVENTOR(S) : Charles Edward Thomas

It is certified that error appears in the above-identified patent and that said Letters Patent is hereby corrected as shown below:

On the title page,

Other Publications, "Simon Renge 'R2'" should be --Simon Rengo "R2"--.

Column 8:

Claim 9, line 19, "related" should be --relation--.

Claim 11, line 32, "the curved heating plate" should be --said upper surface of said at least one plate--.

Claim 12, line 39, "a ear" should be --a rear--.

Signed and Sealed this

Second Day of November, 1993

*Attest:*

Bruce Lehman

BRUCE LEHMAN

*Attesting Officer*

*Commissioner of Patents and Trademarks*